US005758826A

United States Patent [19]

Nines

[11] Patent Number: 5,758,826

[45] Date of Patent: Jun. 2, 1998

[54] FUEL INJECTOR WITH INTERNAL HEATER

[75] Inventor: Jerry Edward Nines, Newport News, Va.

[73] Assignee: Siemens Automotive Corporation, Auburn Hills, Mich.

[21] Appl. No.: 627,707

[22] Filed: Mar. 29, 1996

[51] Int. Cl.[6] ..... B05B 1/24

[52] U.S. Cl. ..... 239/136; 239/139; 239/533.9; 239/533.12; 239/585.1; 219/205; 219/504; 123/549

[58] Field of Search ..... 239/135, 136, 239/139, 533.9, 533.12, 585.1; 219/205, 270, 504; 123/549, 557; 392/484

[56] References Cited

U.S. PATENT DOCUMENTS

| | | | |
|---|---|---|---|
| 3,868,939 | 3/1975 | Friese et al. | 123/179 L |
| 3,876,861 | 4/1975 | Wightman et al. | 219/463 |
| 3,927,300 | 12/1975 | Wada et al. | 219/381 |
| 4,279,234 | 7/1981 | Marcoux et al. | 123/549 |
| 4,447,706 | 5/1984 | Eder et al. | 219/299 |
| 4,458,655 | 7/1984 | Oza | 123/558 |
| 4,572,146 | 2/1986 | Grunwald et al. | 123/549 |
| 4,627,405 | 12/1986 | Imhof et al. | 123/549 |
| 4,633,069 | 12/1986 | Berg et al. | 219/553 |
| 4,713,524 | 12/1987 | Leo et al. | 219/307 |
| 4,834,043 | 5/1989 | Kaczynski et al. | 123/549 |
| 4,870,249 | 9/1989 | Kayanuma et al. | 219/206 |
| 4,898,142 | 2/1990 | Van Wechem et al. | 123/557 |
| 5,218,943 | 6/1993 | Takeda et al. | 123/531 |
| 5,389,195 | 2/1995 | Ouderkirk et al. | 156/643 |
| 5,400,969 | 3/1995 | Keene | 219/205 |
| 5,401,935 | 3/1995 | Smith et al. | 219/206 |
| 5,609,297 | 3/1997 | Gladigow et al. | 239/135 |

*Primary Examiner*—Andres Kashnikow
*Assistant Examiner*—Lisa Ann Douglas
*Attorney, Agent, or Firm*—Russel C. Wells

[57] ABSTRACT

An internal heater for a fuel injector includes an array of plates of a positive temperature coefficient (PTC) material arranged about the valve element in a square tube shape, and surrounded by a heat insulating polytetrafluorethylene sleeve. The plates are preferably coated with polyimide to be protected from the fuel which flows over both surfaces of the plates. Electrical connections are established by inner and outer bands attached to the plates, with a conductive disc having tabs extending to the bands. Spring-loaded contact pins located radially outward from a seal on the disc have wires extending to the connector body contacts of the injector.

11 Claims, 3 Drawing Sheets

FUEL INJECTOR WITH INTERNAL HEATER

BACKGROUND OF THE INVENTION

This invention concerns fuel injectors for internal combustion engines. Conventional fuel injectors comprise a housing having an internal passage and the injector is installed in a fuel rail to supply the passage with fuel under pressure. A solenoid operated needle valve is moved on and off a valve seat to control the outflow of fuel from the injector from the injector tip. The injector tip is received in a bore in an intake manifold or cylinder head runner passage so that the fuel is injected into the intake manifold or cylinder head runner.

The fuel injected is in the form of a spray as an aid to vaporization of the fuel.

When the engine is cold, fuel vaporization is nonetheless difficult to achieve, and for this reason cold starts account for a large proportion of the total engine emissions.

Heaters for fuel injectors have been proposed to overcome this problem, typically taking the form of external heater jackets surrounding the injector.

Another approach is described in U.S. Pat. No. 4,898,142 issued on Feb. 6, 1990 for a "Combustion Engine with Fuel Injection System, and a Spray Valve for Such an Engine." This describes a heating element comprised of a so-called thermistor of a "positive temperature coefficient" or PTC material, typically a ceramic.

PTC thermistor heaters have the characteristic of being self limiting in that a great increase in electrical resistance occurs at a particular temperature so that the fuel can be automatically heated to a predetermined temperature without complicated controls, this characteristic temperature is achieved in a few seconds.

U.S. Pat. No. 4,279,234 is referenced in U.S. Pat. No. 4,898,142 as describing PTC material in detail. A published brochure describing such materials is available from Siemens Matshushita Components GmbH & Co., Balanstrasse 73, 81541 Munchen, Order No. B51P2532/X/X/7600 (1993 edition).

U.S. Pat. No. 4,898,142 describes a tablet of PTC material connected to a metal box acting as a heat sink, fuel impacting the tablet and then flowing through a spiral passage extending around the surface of the heat sink in order to transfer heat into the fuel.

In other versions described in the patent, the PTC material is porous, or has axial cavities which receive the fuel flow.

Direct exposure of the PTC material and the electrical connections to the fuel can possibly cause fouling of the surfaces, degrading the performance of the unit, and/or loss of the electrical connection. The small passages provided for fuel flow also present a substantial restriction to fuel flow.

In the first described embodiment, the heater is located above the injector valve so that the fuel will cool to some extent prior to injection, such that the fuel heating is relatively inefficient. It is the object of the present invention to provide an internal heater arrangement for fuel injectors using PTC materials which provides for enhanced heat transfer into the fuel and presenting only minimal flow resistance, but without requiring heat sinks, or involving direct fuel contact with the PTC material or the electrical connections.

SUMMARY OF THE INVENTION

The above object is achieved by an array of plates of PTC material disposed within the valve body extending alongside and surrounding the injector valve element.

The PTC plates are arranged in a generally square tube pattern around a bore in the valve bore, so that fuel can flow lengthwise down along both the front and rear surfaces of each of the PTC plates.

The valve body cavity enclosing the PTC plate has a heat insulating sleeve of a fuel resistant material such as polytetrafluorethylene surrounding the PTC plate array.

The electrical connections are made with the use of a thin annular split disc element positioned above the PTC plates and conductive upper and lower connector track bands are connected to respective ends of the PTC plates, and coated with polyimide.

A pair of tabs extending from the inner diameter of the disc element each connect to a respective track.

An O-ring seal engages an intermediate section of the disc element, while a pair of connections such as spring-loaded contacts engage exposed contact areas lying outside the areas engaged by the O-ring to complete the electrical circuit.

The PTC plates as well as bands acting as electrical connections are preferably coated with a fuel impervious substance, such as polyimide so that fuel flowing over the surfaces does not directly contact the PTC material.

DETAILED DESCRIPTION

In the following detailed description, certain specific terminology will be employed for the sake of clarity and a particular embodiment described but it is to be understood that the same is not intended to be limiting and should not be so construed inasmuch as the invention is capable of taking many forms and variations within the scope of the appended claims.

Figure 1:
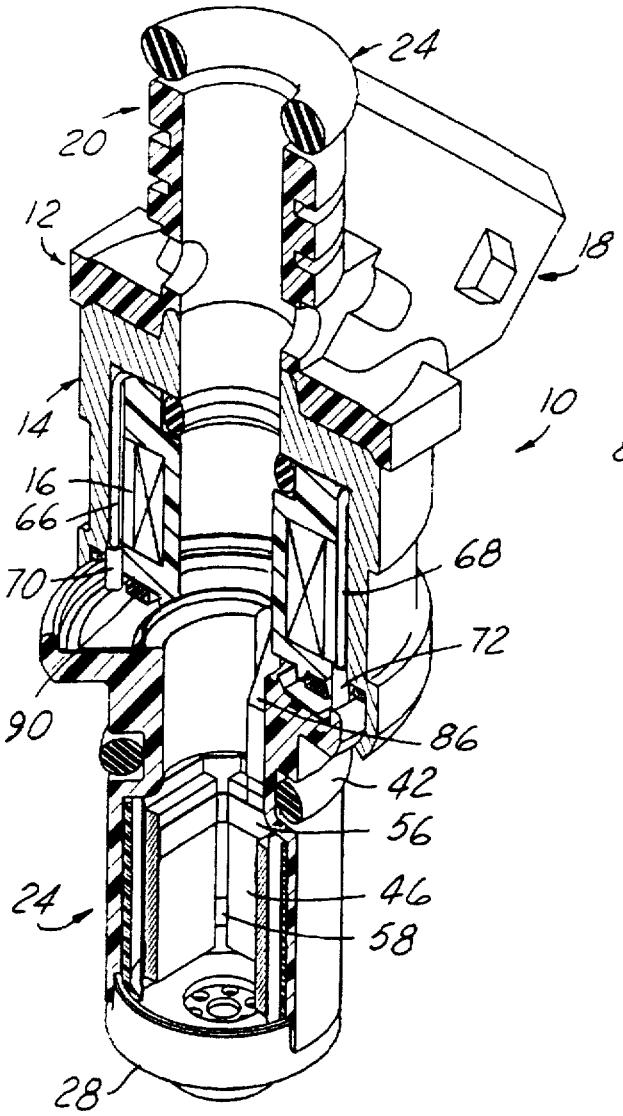
FIG. 1 is a perspective view of a fuel injector having a heater arrangement according to the present invention, the injector having portions broken away and certain internal components removed to reveal the details of the heater arrangement.
Figure 2:
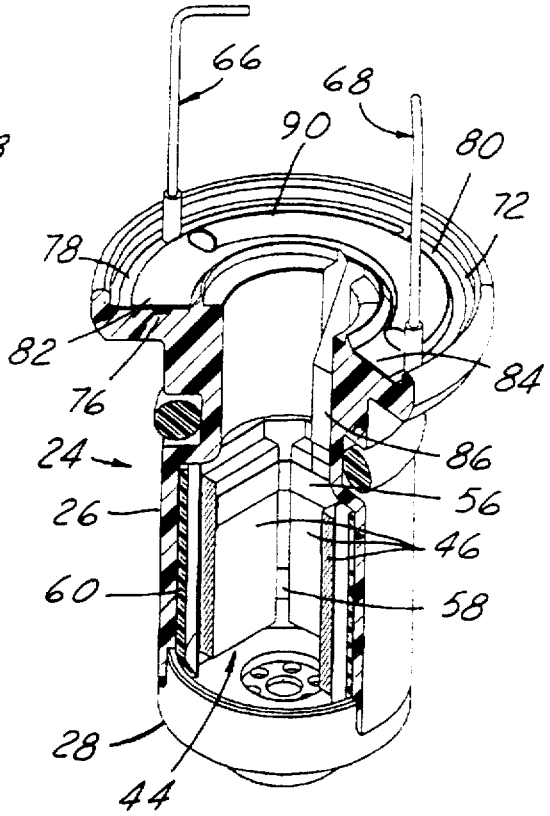
FIG. 2 is an enlarged perspective broken away view of the portion of the injector containing the heater arrangement.

Referring to the drawings and particularly FIG. 1, a fuel injector is shown broken away to reveal internal details.

The injector 10 is a typical design and illustrative of the type with which the internal heater according to the present invention can be used. An upper "power group" 12 subassembly includes a molded outer housing 14 enclosing a solenoid operator 16. An integral molded connector body 18 encapsulates contacts and conductors used to direct electrical power to the solenoid 16 in the well known manner.

An upper housing portion 20 is adapted to be received in a pocket in a fuel rail 23 so as to communicate fuel under pressure to the interior of the injector 10, an O-ring seal 22 sealing the connection.

A "valve group" 24 comprises a lower subassembly mounted to the power group 12 at final assembly, which includes a generally cylindrical valve body 26 having an injector end cap element 28 press fit and welded to its lower end. Around the valve group 24 is an O-ring 42 for sealing the injector 10 in the bore in the intake manifold.

Figure 3:
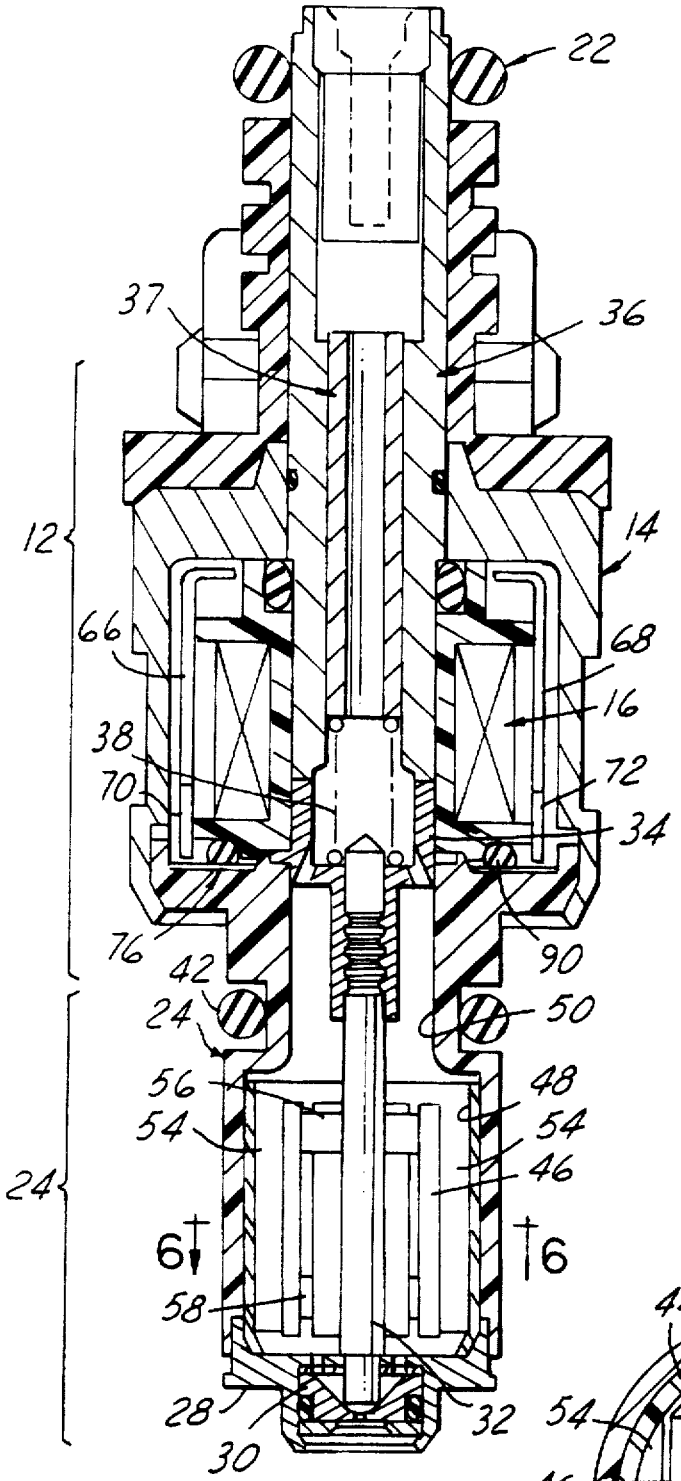
FIG. 3 is a first sectional view of the fuel injector shown in FIG. 1 showing the spring loaded contacts.
Figure 5:
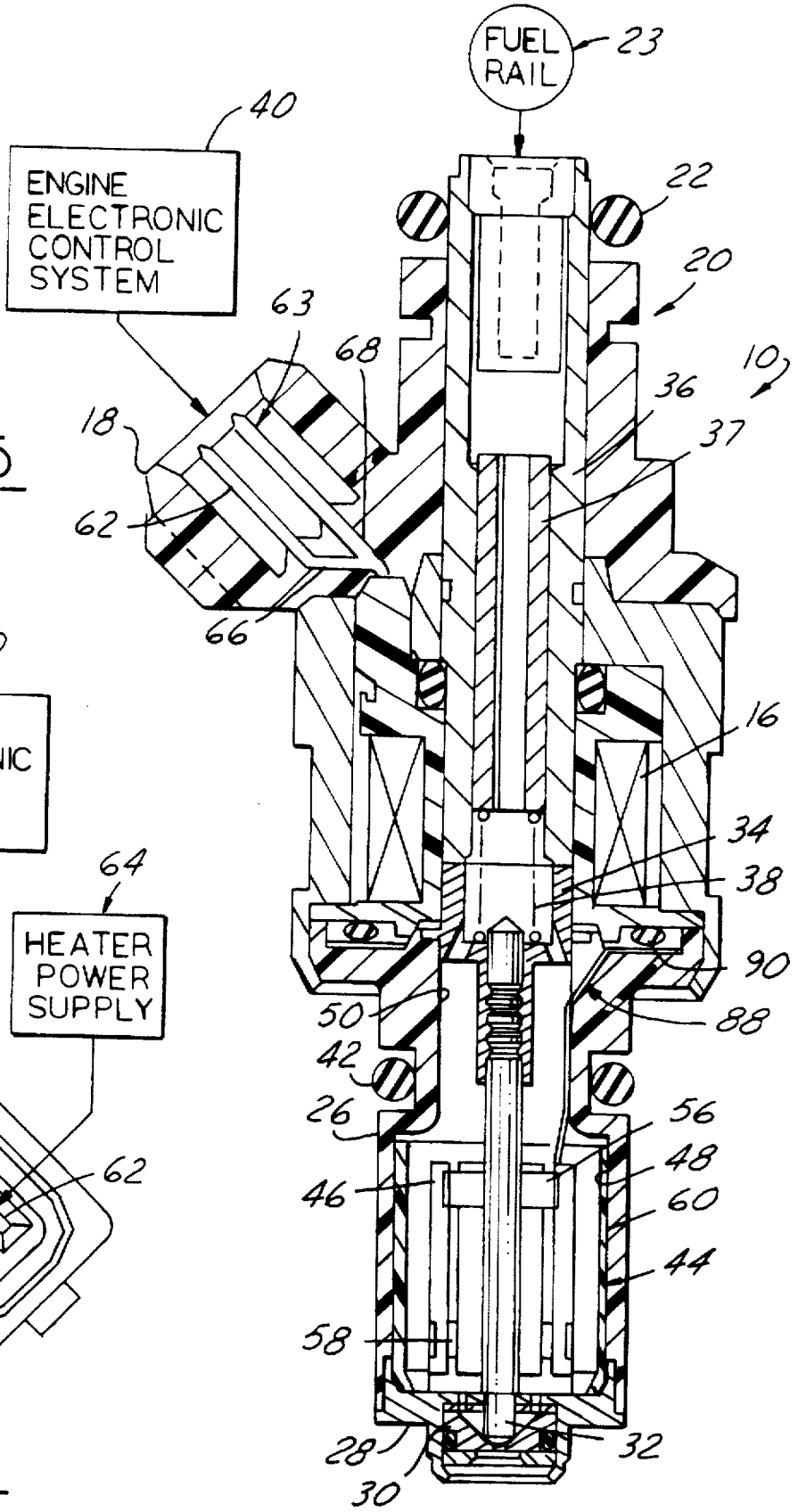
FIG. 5 is a second sectional view of the injector shown in FIG. 1 showing one of the connector tabs from the contact disc to the PTC plate conductor bands.

A valve seat 30 (FIGS. 3 and 5) is mounted in the tip or injector end cap 28, having a surface adapted to mate with the tip of an elongated needle valve element 32. Valve element 32 is swaged to an armature 34 which is drawn against the lower end face of an inlet tube 36 when the solenoid is energized, lifting the tip end of the valve element off the valve seat 30 to allow fuel to flow out of the injector in the well known manner.

A spring 38 is compressed between the armature 34 and an adjusting tube 37 to normally hold the valve element 32 in its seated position.

Figure 4:
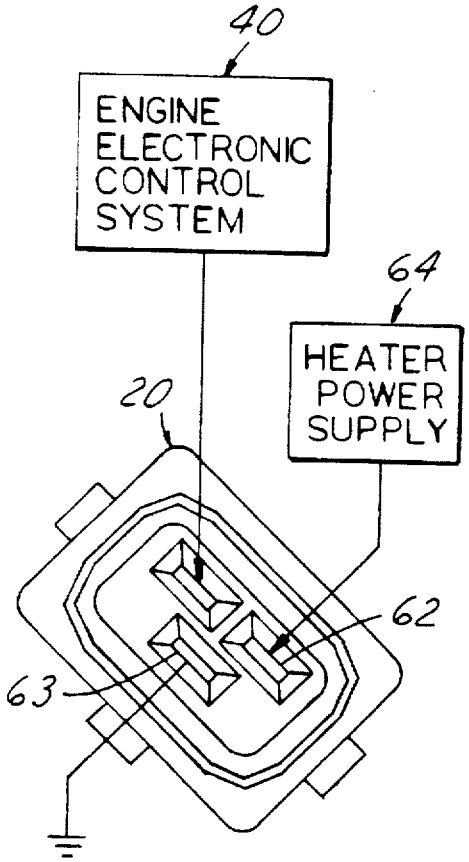
FIG. 4 is an end view of the integral three contact electrical connectors of the injector shown in FIGS. 1 and 3, together with a diagrammatic representation of the connected circuits.

The injector lower end is received in a mating bore in an intake manifold (or cylinder head) (not shown) which receives the fuel sprayed out when the injector valve element 32 is opened. The timing and duration of the opening is controlled by electrical signals received from an engine electronic control system 40 (FIG. 4).

According to the concept of the present invention, an internal heater 44 is contained within the valve group 24 just upstream of the valve seat 30, thereby positioned immediately adjacent the point of exit of the fuel.

Figure 6:
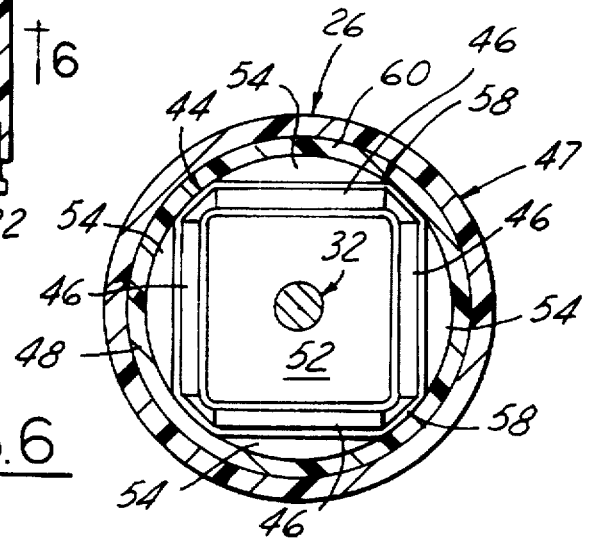
FIG. 6 is a transverse section through the valve body shown in FIGS. 3 and 5.

The heater 44 is comprised of four rectangular plates 46 of a positive temperature coefficient (PTC) material lengthwise arrayed and about the axis of the valve element 32, contained within the valve body 26. The array of PTC plates 46 loosely form a square tube 47 shape confined within the circular bore 48 of the valve body 26 (FIG. 6).

The square tube shape creates intervening spaces 54, and hence fuel entering the bore 50 after passing through the armature 34 flows through spaces 54, as well as central portion 52 of the tube 47 so that fuel comes into contact with both sides of each PTC plate 46. The increased diameter of bore 48 increases the residence time of the fuel in contact with the PTC plates 46 to enhance the transfer of heat into the fuel immediately prior to injection.

An inner conductor track band 56 and outer conductor track band 58 respectively encircle the inner and outer perimeter of the square tube shape, each band 56, 58 electrically and mechanically connected to a respective end of each PTC plate 46 by a suitable electrically conductive adhesive.

In order to further enhance the heater effectiveness, a sleeve 60 of fuel resistant insulating material such as polytetrafluorethylene is installed in the valve body bore 48.

In order to protect the ceramic PTC material, the PTC plates and bands 56, 58 are preferably completely coated with a thin layer (on the order of 0.001 inch thickness) of a fuel impervious coating, such as polyimide, a material available from DuPont. A heat conductive formulation of polyimide aiding heat transfer is preferred. Other suitable coatings may be employed, although the use of a coating may not be necessary.

The PTC plates 46 are supplied with electrical power via the bands 56, 58 which in turn are supplied by connections to contacts 62 in the connector block 20 (FIG. 4), enabling connection to a heater power supply 64.

An internal connection system extends from the contacts 62, 63 to the inner band track 56 and outer band track 58, including embedded wires 66, 68 extending to spring-loaded pins 70, 72 disposed in housing 14 outwardly of the solenoid 16. An annular conductive split disc 76, coated with polyimide is positioned abutting against an upper end of the valve body 24. A pair of conductive tracks 78, 80 are formed by exposed arcuate areas on each respective segment 82, 84 of the split disc 76, each engaged by a tip of a spring loaded pin 70, 72.

Each split disc segment 82, 84 has a downwardly extending tab 86, 88 (FIG. 5) soldered or adhesively attached to a respective track band 56, 58 to complete the circuit.

A suitable groove, not shown, in the valve body 26 allows angling of the tabs 86, 88 inwardly to the bands 56, 58.

An O-ring seal 90 engages the surface of the split disc 76 inside the exposed tracks 78, 80 to prevent fuel contact therewith.

Figure 7:
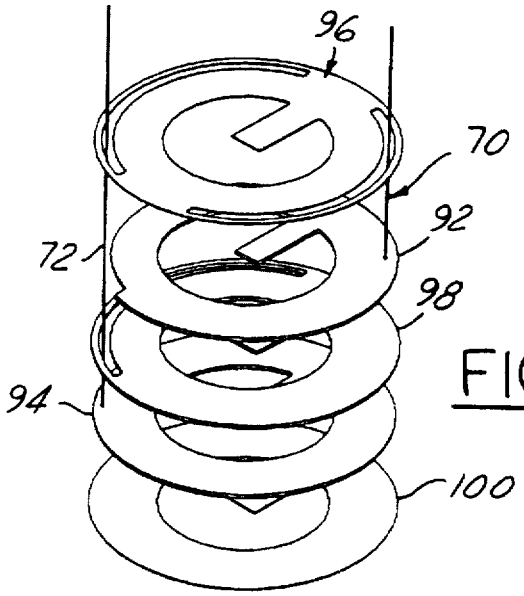
FIG. 7 is an exploded perspective view of an alternate form of the electrical contact disc.

Instead of split disc 76, a pair of conductive annular discs 92, 94 can be used separated and covered by polyimide coating layers 96, 98, 100 having suitable cutouts to enable contact of the pins 70, 72 (FIG. 7).

The use of spring-loaded pins 70, 72 allows easy assembly of the power group 12 to the valve group 24. As a further alternative and for a less bulky design, electrical conductors extending internally within the injector or externally outside of the injector to the bands 56, 58 can be employed.

The PTC material for plates 46 can be selected to be self-limiting at a temperature which will heat the fuel to a desired temperature level, such as 80° C. This technology is itself well known and hence details thereof are not here set forth.

The arrangement described allows efficient heat transfer into the fuel at a point close to that point whereat the fuel is injected.

I claim:

1. A fuel injector for an internal combustion engine including:

a generally cylindrical valve body having an internal bore for the passage of fuel;

a valve seat mounted to a tip end of said valve body;

an elongated needle valve element having a tip end engageable with said valve seat;

a solenoid operator and an armature attached to an opposite end of said valve element enabling unseating of said tip end from said valve seat to enable outflow of fuel from the injector;

a fuel heater mounted within said valve body upstream of said valve seat and inside said internal bore;

first and second conductive tracks attached in a spaced apart relationship to said fuel heater:

a heater power supply; and connector means for electrically connecting said tracks to said heater power supply for energizing said fuel heater.

2. The fuel injector according to claim 1 wherein said fuel heater comprises a structure of positive temperature coefficient material.

3. The fuel injector according to claim 2 wherein said fuel heater comprises an array of rectangular plates arrayed in a generally square tube shape about said needle valve element, fuel flowing through spaces on front and back surfaces of each plate.

4. The fuel injector according to claim 3 wherein said first and second tracks comprise bands extending about the perimeter of said plates arranged in a general square tube shape.

5. A. The fuel injector according to claim 4 wherein said plates are coated to be fuel impervious.

6. The fuel injector according to claim 1 wherein a heat insulating sleeve is mounted within said valve body surrounding said fuel heater.

7. The fuel injector according to claim 6 wherein said sleeve is constructed of polytetrafluorethylene.

8. The fuel injector according to claim 1 wherein said connector means includes an annular conductive disc mounted in said injector abutting an upper end of said valve body, an O-ring seal engaged against an upper face of said disc, electrical connections to an outer perimeter of said disc, and tabs integral with an inner diameter of said disc connected to said first and second tracks, respectively.

9. The fuel injector according to claim 8 wherein said annular disc is split to provide separate electrical paths.

10. The fuel injector according to claim 8 wherein said annular disc is comprised of a pair of separate disc elements stacked together with an interposed layer of electrically insulating material, and having an outer coating of electrically insulating material thereon.

11. The fuel injector according to claim 8 wherein spring-loaded contact pins comprise said connections to said outer perimeter of said discs.

* * * * *